US010968062B2

(12) United States Patent
Yamaki

(10) Patent No.: US 10,968,062 B2
(45) Date of Patent: Apr. 6, 2021

(54) TRANSFER TRANSPORTING DEVICE AND IMAGE FORMING APPARATUS

(71) Applicant: FUJI XEROX Co., Ltd., Tokyo (JP)

(72) Inventor: Hiromoto Yamaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 155 days.

(21) Appl. No.: 16/270,229

(22) Filed: Feb. 7, 2019

(65) Prior Publication Data

US 2020/0095078 A1 Mar. 26, 2020

(30) Foreign Application Priority Data

Sep. 21, 2018 (JP) ..... JP2018-176971

(51) Int. Cl.
*G03G 15/00* (2006.01)
*B65H 5/02* (2006.01)

(52) U.S. Cl.
CPC ..... *B65H 5/025* (2013.01); *G03G 15/65* (2013.01)

(58) Field of Classification Search
None
See application file for complete search history.

(56) References Cited

U.S. PATENT DOCUMENTS 5,573,104 A * 11/1996 Kibayashi ..... B65G 39/16 198/840
6,192,210 B1 * 2/2001 Munenori ..... G03G 15/0131 399/165
6,397,033 B1 * 5/2002 Todome ..... B65H 5/021 399/165
2016/0334737 A1 * 11/2016 Kichise ..... G03G 15/161

FOREIGN PATENT DOCUMENTS

JP 2005-257863 A 9/2005

* cited by examiner

*Primary Examiner* — Jas A Sanghera
(74) *Attorney, Agent, or Firm* — Sughrue Mion, PLLC

(57) ABSTRACT

A transfer transporting device includes multiple rollers, an endless belt, a pair of support members, and a pair of unloading members. The rollers include a driving roller and a driven roller. The driving roller is disposed closer to an image carrier that has a toner image formed thereon and that holds the toner image. The driven roller is disposed apart from the driving roller downstream in a sheet transport direction. The endless belt is wound around the rollers. The pair of support members each have an outer wall surface facing a side end surface of the belt. The pair of support members are disposed on both sides of the belt to rotatably support a rotation shaft protruding from side end surfaces of the driving roller. The pair of unloading members are interposed between the outer wall surfaces of the pair of support members and the side end surfaces of the driving roller. The pair of unloading members each reduce, while being in contact with a corresponding one of the side end surfaces of the belt, a driving load on the driving roller further than in a case where the side end surfaces of the belt come into direct contact with the outer wall surfaces. The image carrier and the belt hold therebetween a sheet transported thereto to transfer the toner image on the image carrier to the sheet, and transport the sheet downstream.

14 Claims, 10 Drawing Sheets

TRANSFER TRANSPORTING DEVICE AND IMAGE FORMING APPARATUS

CROSS-REFERENCE TO RELATED APPLICATIONS

This application is based on and claims priority under 35 USC 119 from Japanese Patent Application No. 2018-176971 filed Sep. 21, 2018.

BACKGROUND

(i) Technical Field

The present disclosure relates to a transfer transporting device and an image forming apparatus.

(ii) Related Art

A transfer transporting device is known in which multiple rollers including a driving roller stretch an endless belt, the belt is driven by the driving roller to rotate, an image carrier and the belt hold a sheet therebetween to transfer a toner image on the image carrier to the sheet, and the belt transports the sheet downstream to subject the sheet to a fixing step.

In such a transfer transporting device, while being driven, a belt may be deviated to one side due to various causes such as alignment adjustment errors of roller axes, the profile difference in the axial direction of rollers, or misalignment between the level and the floor on which the image forming apparatus including the transfer transporting device is installed. Particularly, an elastic belt included in a transfer transporting device is more likely to be deviated to one side with reduction of control on belt deviation due to, for example, a change of the belt tension and deterioration of the surface properties with time. With the progress of the belt deviation, a belt may be worn by the friction between the side end surface of the belt and the wall surface of a support member that supports a driving roller to form dust, which adversely affects the transfer electric field and causes an image defect. Further progress of wearing may cause belt breakage.

Japanese Patent Application Publication No. 2005-257863 discloses a technology to control belt deviation by obliquely bringing a guide member into contact with a side edge of a temporarily deviated belt to bend the belt so as to make the side edge of the belt narrower.

SUMMARY

Aspects of non-limiting embodiments of the present disclosure relate to a transfer transporting device and an image forming apparatus that prevent wearing of a belt even when the belt is deviated to one side.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an exemplary embodiment of the disclosure, a transfer transporting device includes multiple rollers, an endless belt, a pair of support members, and a pair of unloading members. The rollers include a driving roller and a driven roller. The driving roller is disposed closer to an image carrier, which has a toner image formed thereon and holds the toner image. The driven roller is disposed apart from the driving roller downstream in a sheet transport direction. The endless belt is wound around the rollers. The pair of support members each have an outer wall surface facing a side end surface of the belt. The pair of support members are disposed on both sides of the belt to rotatably support a rotation shaft protruding from side end surfaces of the driving roller. The pair of unloading members are interposed between the outer wall surfaces of the pair of support members and the side end surfaces of the driving roller. The pair of unloading members each reduce, while being in contact with a corresponding one of the side end surfaces of the belt, a driving load on the driving roller further than in a case where the side end surfaces of the belt come into direct contact with the outer wall surfaces. The image carrier and the belt hold therebetween a sheet transported thereto to transfer the toner image on the image carrier to the sheet, and transport the sheet downstream.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will now be described, below.

Figure 1:
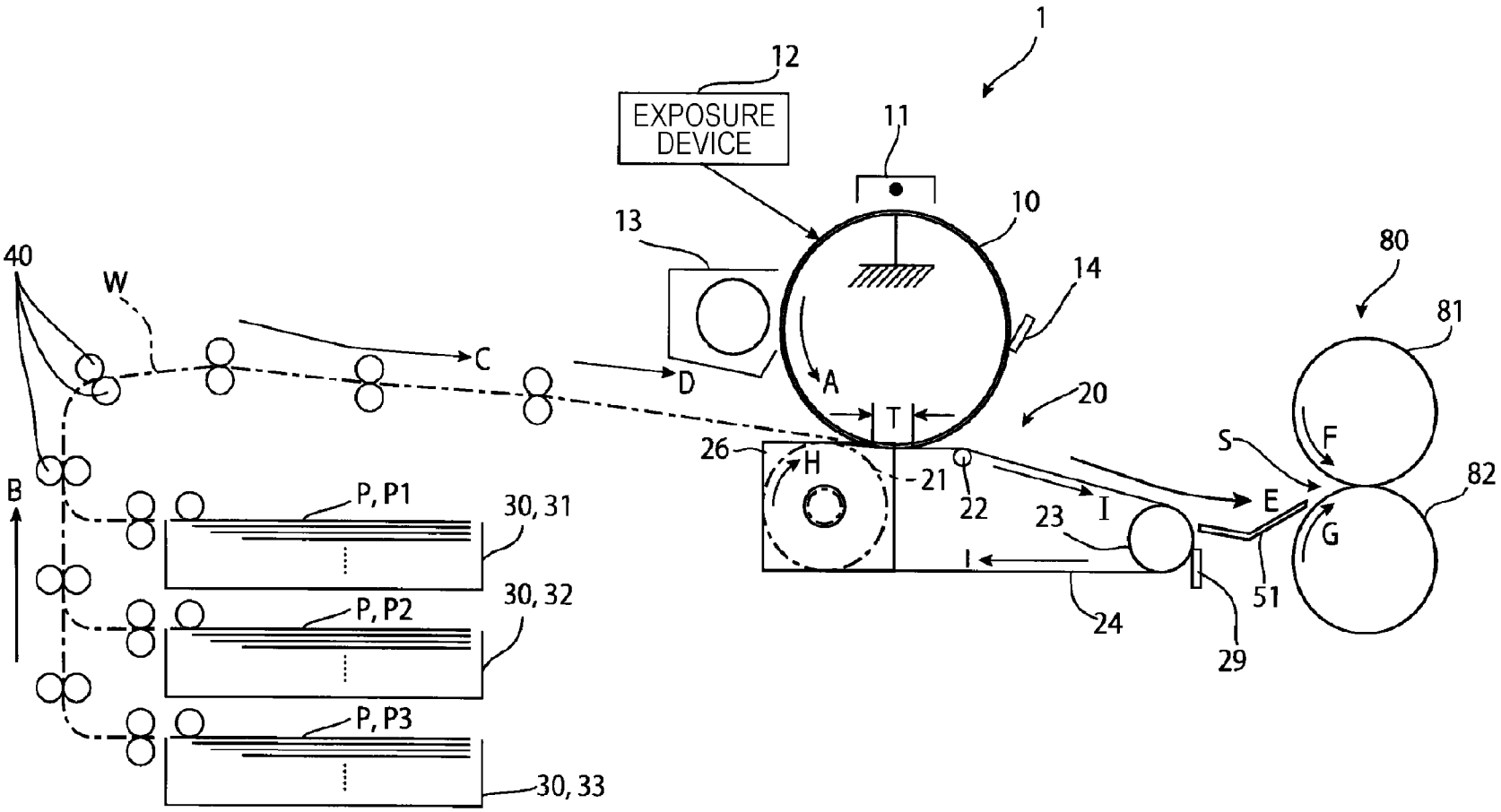
FIG. 1 is a schematic diagram of the structure of an image forming apparatus according to a first exemplary embodiment of the present disclosure.

FIG. 1 is a schematic diagram of the structure of an image forming apparatus according to a first exemplary embodiment of the present disclosure. The image forming apparatus illustrated in FIG. 1 includes a transfer transporting device according to an exemplary embodiment of the present disclosure.

An image forming apparatus 1 includes an image carrier 10. The image carrier 10 is rotatably supported by a frame, not illustrated, and rotates in the direction of arrow A. Around the image carrier 10, a charging device 11, an exposure device 12, and a developing device 13 are disposed. After being subjected to charging, exposure, and development processes, the image carrier 10 has a toner image formed thereon, and the toner image is temporarily held on the image carrier 10.

The image forming apparatus 1 also includes three sheet trays 30, which are removably attached. Each sheet tray 30 accommodates a stack of sheets P.

From a stack of sheets P in a designated one of the three sheet trays 30, a sheet P is picked up and transported by sheet transport members 40 along a sheet transport path W in the directions of arrows B, C, and D.

The sheet P transported in the direction of arrow D enters a contact area T, formed by the image carrier 10 and a transfer belt 24 of a transfer transporting device 20, described below, coming into contact with each other. In this contact area T, a transfer electric field is formed by an application of a transfer bias. While passing through the contact area T, the sheet P has a toner image on the image carrier 10 transferred thereto with the effect of the transfer electric field. The sheet P that has had the toner image transferred thereto is further transported in the direction of arrow E to a fixing device 80. The fixing device 80 includes a heat roller 81, which rotates in the direction of arrow F, and a pressing roller 82, which rotates in the direction of arrow G. The heat roller 81 and the pressing roller 82 come into contact with each other to form a fixing area S.

The sheet P that has travelled in the direction of arrow E enters the fixing area S, and, while passing through the fixing area S, is heated and pressed to have the toner image on the sheet P fixed to the sheet P.

After the toner image is transferred in the contact area T, toner remaining on the image carrier 10 is removed by a cleaner 14 from the surface of the image carrier 10.

The transfer transporting device 20 includes a driving roller 21, a pressing roller 22, a driven roller 23, an endless transfer belt 24, wound around the rollers 21, 22, and 23, a pair of support members 25 (refer to FIG. 3), which support the rollers such as driving rollers, and a sliding member 26.

Here, the driving roller 21 rotates in the direction of arrow H to drive the transfer belt 24. The transfer belt 24 is formed from an elastic belt, and circularly moves in the direction of arrow I with the driving force of the driving roller 21. The transfer belt 24 corresponds to an example of an endless belt according to an exemplary embodiment of the disclosure. In accordance with the circular movement of the transfer belt 24, the pressing roller 22 and the driven roller 23 are driven to rotate.

The driving roller 21 is located upstream, in the sheet transport direction, of the rotation axis of the image carrier 10, and presses the transfer belt 24 toward the image carrier 10 from the inner side of the transfer belt 24. On the other hand, the pressing roller 22 is located downstream, in the sheet transport direction, of the rotation axis of the image carrier 10, and presses the transfer belt 24 toward the image carrier 10 from the inner side of the transfer belt 24. Thus, the above-described contact area T, in which the image carrier 10 and the transfer belt 24 are in contact with each other, is formed in the area between the driving roller 21 and the pressing roller 22. The sheet P that has passed through the contact area T is transported by the transfer belt 24 toward the driven roller 23 disposed downstream in the sheet transport direction.

The driven roller 23 is a roller having a smaller diameter than the driving roller 21. The driven roller 23 acutely changes the direction in which the transfer belt 24 travels to separate the leading end of the sheet P mounted on the transfer belt 24 from the transfer belt 24. The sheet P separated from the transfer belt 24 is guided by a guide member 51 in the direction of arrow E, and, as described above, passes through the fixing area S of the fixing device 80 to be heated and pressed and to have the toner image on the sheet P fixed to the sheet P. Thus, an image formed of a fixed toner image is formed on the sheet P. The sheet P on which an image is formed is fed to a sheet output tray, not illustrated, disposed outside of the image forming apparatus 1.

The transfer transporting device 20 includes a cleaner 29. Toner or other impurities adhering to the transfer belt 24 is removed by the cleaner 29 from the transfer belt 24.

Figure 2:
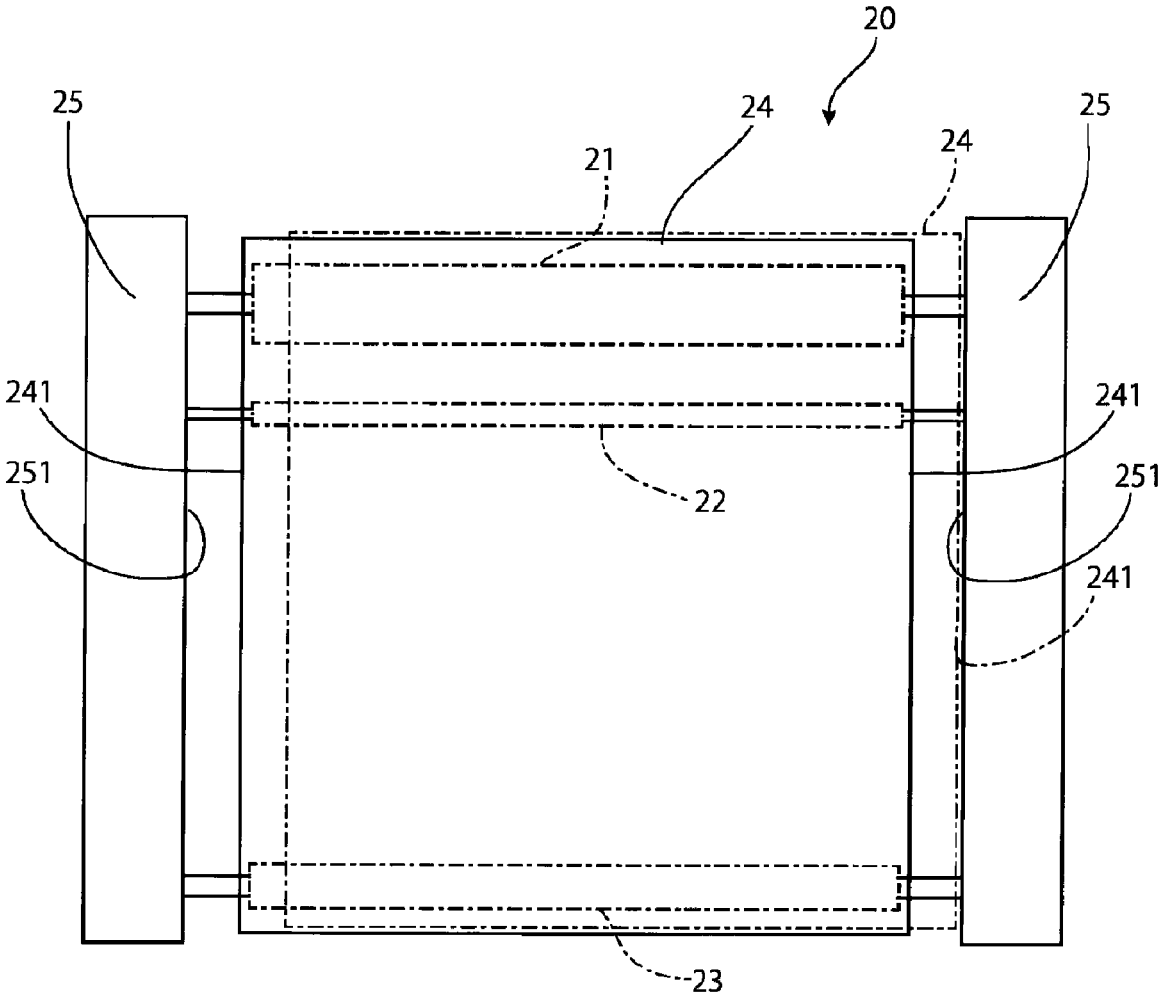
FIG. 2 RELATED ART
FIG. 2 is a schematic diagram of an existing example of a transfer transporting device.

FIG. 2 is a schematic diagram of an example of an existing transfer transporting device. FIG. 2 corresponds to a comparative example of the present disclosure. For ease of understanding, also in FIG. 2, components the same as those of the transfer transporting device according to the exemplary embodiment of the present disclosure are denoted with the same reference signs as those denoting the components of the transfer transporting device according to the exemplary embodiment.

As illustrated in FIG. 2, the driving roller 21, the pressing roller 22, and the driven roller 23 are supported by the pair of support members 25, disposed on both sides.

Here, in an existing transfer transporting device 20, due to various causes such as position misalignment of each roller, assembly tolerance of the transfer transporting device 20, or misalignment between the level and the floor on which the image forming apparatus including the transfer transporting device 20 is installed, the transfer belt 24 may be deviated to one side when the transfer belt 24 is driven, as illustrated with a dot-dash line in FIG. 2. Here, an elastic belt is used as an example of the transfer belt 24. The transfer belt 24 is thus more likely to be deviated to one side due to, for example, a change of the tension or deterioration of the surface properties of the transfer belt 24 with time. The deviation may cause an outer wall surface 251 of one support member 25, which supports the driving roller 21, facing a side end surface 211 of the driving roller 21 to come into contact with a corresponding side end surface 241 of the transfer belt 24, and the transfer belt 24 may be worn by friction between the outer wall surface 251 and the side end surface 241 to form dust, which may adversely affect the transfer electric field in the contact area T (refer to FIG. 1) and cause an image defect. Further progress of wearing may cause belt breakage.

On the basis of the existing problems described thus far with reference to FIG. 2, a transfer transporting device according to an exemplary embodiment of the present disclosure will now be described.

Figure 3:
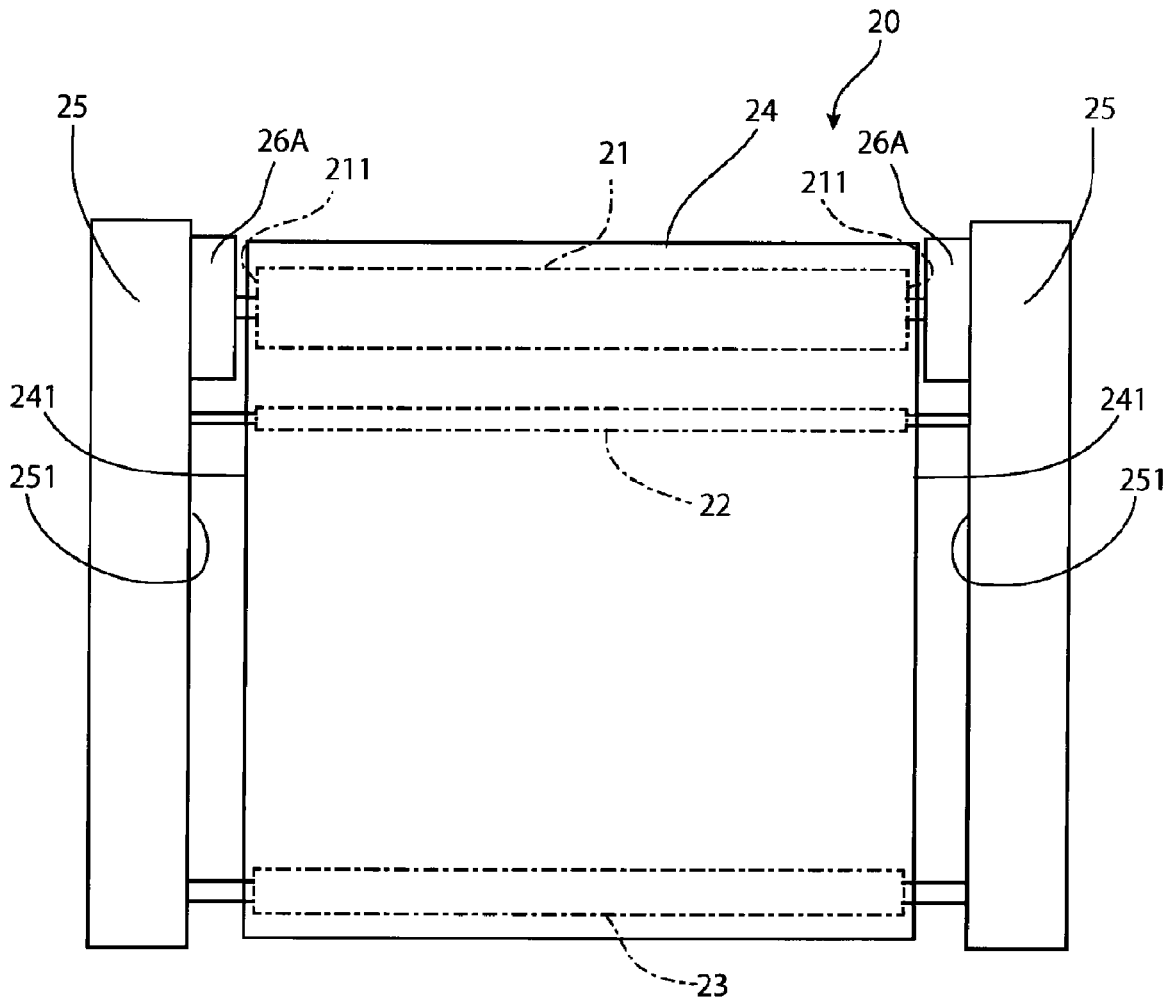
FIG. 3 is a schematic diagram of a transfer transporting device according to the first exemplary embodiment of the present disclosure.

FIG. 3 is a schematic diagram of a transfer transporting device according to a first exemplary embodiment of the present disclosure. In the description with reference to FIG. 3, the components described with reference to FIG. 2 are not described redundantly, and components added from FIG. 2 are mainly described.

Figure 4:
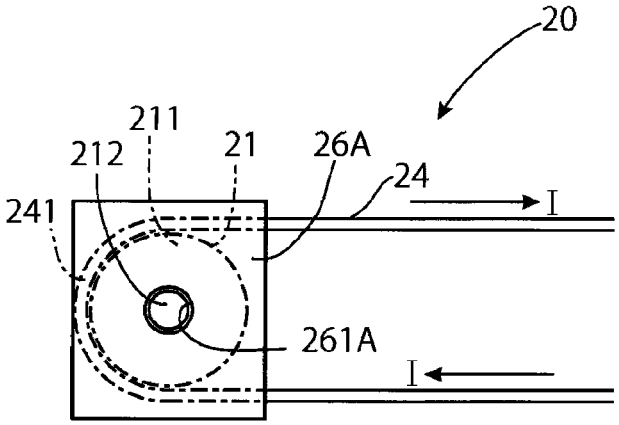
FIG. 4 is a side view of a portion of the transfer transporting device illustrated in FIG. 3, including a driving roller.

FIG. 4 is a side view of a portion of the transfer transporting device illustrated in FIG. 3, including a driving roller. Arrow I denotes a direction in which the transfer belt moves circularly.

The transfer transporting device 20 illustrated in FIG. 3 includes a pair of sliding members 26A. The pair of sliding members 26A are disposed between the respective outer wall surfaces 251 of the pair of support members 25 and the side end surfaces 211 of the driving roller 21. The sliding members 26A according to the exemplary embodiment are fixed to the outer wall surfaces 251 of the support members 25 by bonding. Instead of bonding, the sliding members 26A may be fixed to the support members 25 with screws at positions at which they do not interfere with the transfer belt 24, or may be fixed with any other devices.

Here, as examples of the sliding members 26A, rectangular flat plates made of polyacetal (POM) and each having a hole 261A to prevent interference with a rotation shaft 212 of the driving roller 21 are employed. The sliding members 26A made of POM have a coefficient of friction between themselves and the side end surfaces 241 of the transfer belt 24, lower than the coefficient of friction caused when the side end surface 241 of the transfer belt 24 comes into direct contact with the outer wall surface 251 of the support member 25. This structure prevents dust from being formed when the transfer belt 24 is deviated to one side and one sliding member 26A and the corresponding side end surface 241 of the transfer belt 24 slide over each other. The sliding members 26A correspond to an example of a friction reducing member according to an exemplary embodiment of the disclosure. Employing the sliding members 26A further reduces driving load caused to drive the driving roller 21 than in the case where the side end surface 241 of the transfer belt 24 directly slides over the corresponding outer wall surface 251 of the support member 25. Thus, the sliding members 26A correspond to an example of an unloading member of an exemplary embodiment of the disclosure. This driving load is known by measuring power applied to a driving motor, not illustrated, that drives the driving roller 21 or the load current of the motor.

Figure 5:
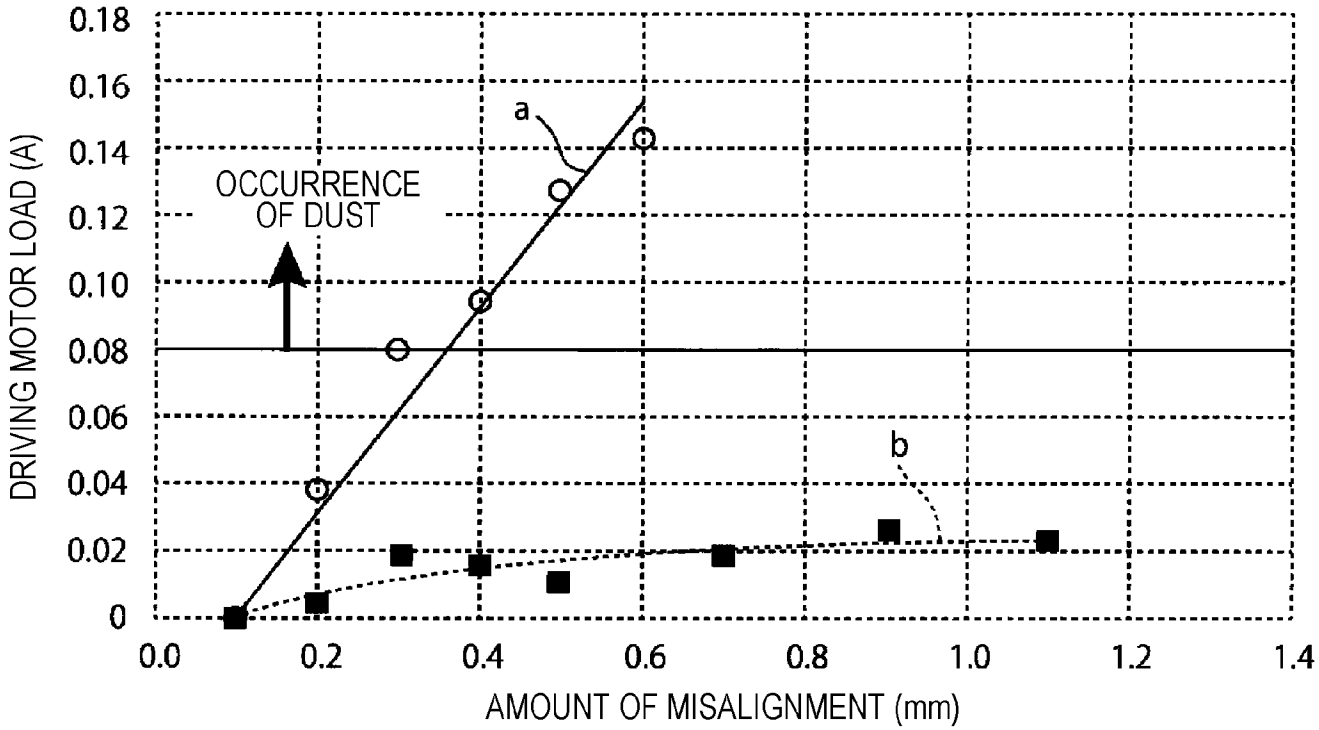
FIG. 5 illustrates a load current of a driving motor with respect to roller misalignment.

FIG. 5 illustrates the load current of the driving motor with respect to the roller misalignment. The horizontal axis of FIG. 5 represents an amount of misalignment of the driven roller 23 from the position parallel to the driving roller 21. For example, the point at 1.0 (mm) of the horizontal axis denotes that the second end of the driven roller 23 is shifted by 1 mm with respect to the first end of the driven roller 23 from the position parallel to the driving roller 21 to lower the degree of parallelization. The vertical axis of FIG. 5 represents the current value of the load current that flows to the driving motor that drives the driving roller 21.

FIG. 5 illustrates two graphs, a graph a and a graph b. The graph a is a graph for a comparative example not including the sliding members 26A, as illustrated in FIG. 2. The graph b is a graph for an example including the sliding members 26A, as illustrated in FIGS. 3 and 4. As the amount of misalignment increases, the force of pressing one side end surface 241 of the transfer belt 24 against the corresponding outer wall surface 251 of the support member 25 (in the case of graph a) or the corresponding sliding member 26 (in the case of graph b) increases.

In the graph a, as the amount of misalignment increases, the load current sharply increases substantially in proportion to the increase of the misalignment. In the graph b, on the other hand, the load current is saturated at approximately 0.02 (A) even after misalignment significantly increases. In observation, dust occurs when the load current exceeds 0.08 (A), and the amount of dust increases with an increase of the load current. The structure including the sliding members 26A reduces the load current to a sufficiently low level.

Here, the sliding members 26A made of POM have been described. However, the structure including the sliding members 26A made of fluororesin (PTFE) also reduces the load current to a sufficiently low level.

Subsequently, sliding members of various different modification examples are described.

Figure 6:
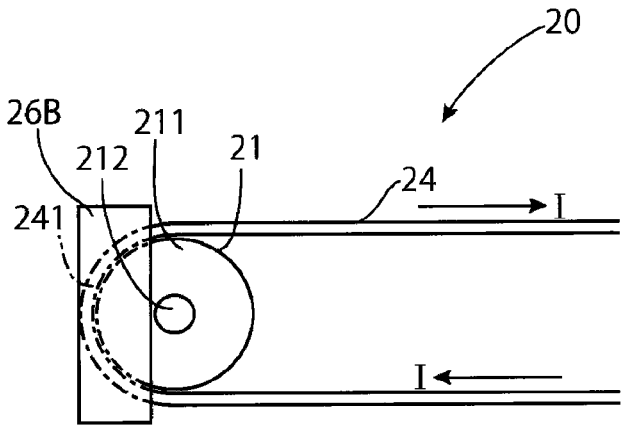
FIG. 6 illustrates a first modification example of a sliding member, and is a side view corresponding to FIG. 4.

FIG. 6 is a side view of a sliding member according to a first modification example, corresponding to FIG. 4. Arrow I denotes a direction in which the transfer belt moves circularly.

When projected in the direction of the rotation shaft 212 of the driving roller 21, a sliding member 26B illustrated in FIG. 6 extends to cover a portion of the side end surface 241 of the transfer belt 24 upstream, in the sheet transport direction, of the rotation shaft 212.

The sliding member 26B is a member having a simple shape, such as a rectangular plate, and reduces the cost.

Figure 7:
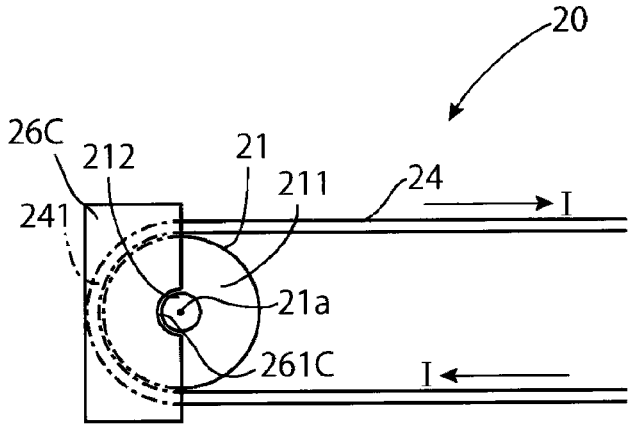
FIG. 7 illustrates a second modification example of a sliding member, and is a side view corresponding to FIG. 4.

FIG. 7 is a side view of a sliding member according to a second modification example, corresponding to FIG. 4. Arrow I denotes the direction in which the transfer belt moves circularly.

When projected in the direction of the rotation shaft 212 of the driving roller 21, a sliding member 26C covers a portion of the side end surface 241 of the transfer belt 24 upstream, in the sheet transport direction, of the rotation shaft 212. To prevent interference with the rotation shaft 212, the sliding member 26C has a groove 261C, and extends to a center point 21*a* of the rotation shaft 212 in the sheet transport direction.

The sliding member 26C is in contact with a portion of the side end surface 241 of the transfer belt 24 over a full length having its rigidity retained by being wound around the driving roller 21.

Figure 8:
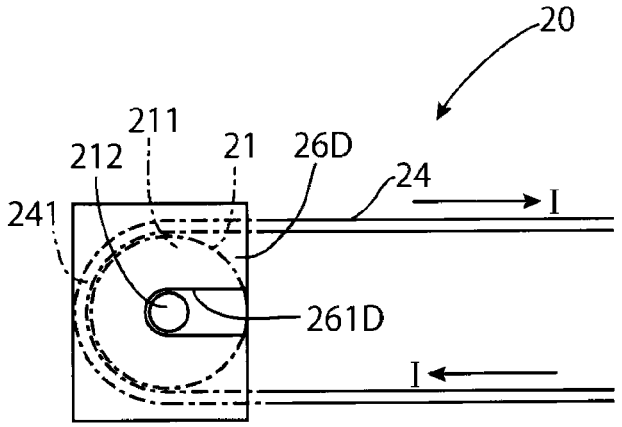
FIG. 8 illustrates a third modification example of a sliding member, and is a side view corresponding to FIG. 4.

FIG. 8 is a side view of a sliding member according to a third modification example, corresponding to FIG. 4. Arrow I denotes the direction in which the transfer belt moves circularly.

When projected in the direction of the rotation shaft 212 of the driving roller 21, a sliding member 26D covers a portion of the side end surface 241 of the transfer belt 24 upstream, in the sheet transport direction, of the rotation shaft 212. The sliding member 26D has a groove 261D to prevent interference with the rotation shaft 212, and extends to the downstream edge of the side end surface 211 of the driving roller 21 in the sheet transport direction.

The sliding member 26D is in contact with an area larger than the full length of a portion of the side end surface 241 of the transfer belt 24 having its rigidity retained by being wound around the driving roller 21.

Figure 9:
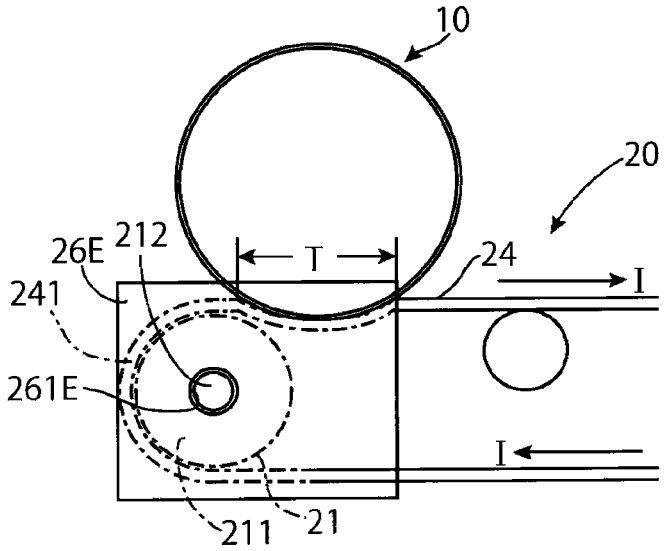
FIG. 9 illustrates a fourth modification example of a sliding member, and is a side view corresponding to FIG. 4.

FIG. 9 is a side view of a sliding member according to a fourth modification example, corresponding to FIG. 4. FIG. 9 illustrates a contact area T with an image carrier. Arrow I denotes the direction in which the transfer belt moves circularly.

When projected in the direction of the rotation shaft 212 of the driving roller 21, a sliding member 26E covers a portion of the side end surface 241 of the transfer belt 24 upstream, in the sheet transport direction, of the rotation shaft 212. The sliding member 26E has a hole 261E that prevents interference with the rotation shaft 212, and extends to the downstream edge, in the sheet transport direction, of the contact area T between the transfer belt 24 and the image carrier 10.

The sliding member 26E is in contact with the belt side end surface over an area wider than the area over which the sliding member 26D illustrated in FIG. 8 extends. Since the transfer belt 24 is in contact with the image carrier 10, the contact area T is more likely to be firmly pressed against the sliding member 26E when the transfer belt 24 is deviated to one side. In the example illustrated herein, the sliding member 26E having a low coefficient of friction extends to the contact area T. Thus, even when the transfer belt 24 is firmly pressed against the sliding member 26E, occurrence of dust is effectively prevented.

In the example illustrated in FIG. 9, the sliding member 26E extends to the downstream edge, in the sheet transport direction, of the contact area T between the transfer belt 24 and the image carrier 10. However, the sliding member 26E does not necessarily have to extend to the downstream edge of the contact area, and may extend to any portion of the contact area.

Figure 10:
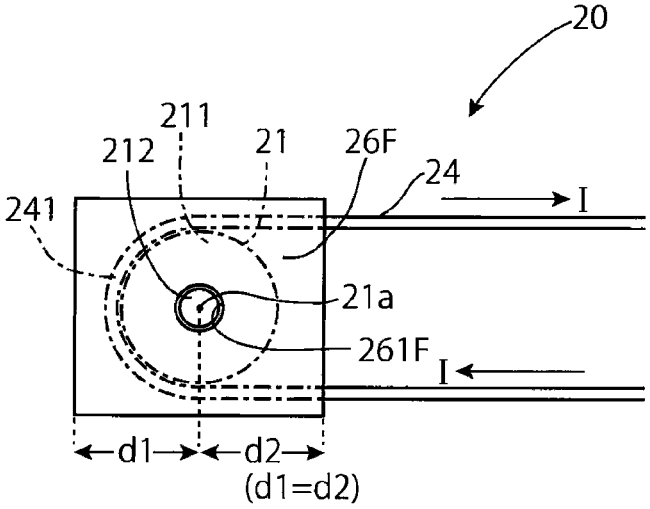
FIG. 10 illustrates a fifth modification example of a sliding member, and is a side view corresponding to FIG. 4.

FIG. 10 is a side view of a sliding member according to a fifth modification example, corresponding to FIG. 4. Arrow I denotes the direction in which the transfer belt moves circularly.

A sliding member 26F has a hole 261F, which allows the rotation shaft 212 to be inserted thereinto. When projected in the direction of the rotation shaft 212 of the driving roller 21, the sliding member 26F has an area in the upstream side in the sheet transport direction, that covers the most upstream edge, in the sheet transport direction, of the side end surface 241 of the transfer belt 24. The sliding member 26F extends upstream and downstream in the sheet transport direction by the same distance from the center point 21*a* of the rotation shaft 212.

The sliding member 26F, having its upstream and downstream sides in the sheet transport direction symmetrical, is attachable while having its upstream and downstream sides reversed. This structure thus reduces attachment errors.

Figure 11:
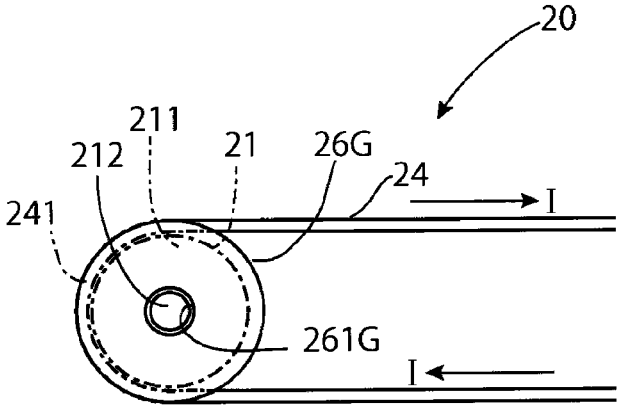
FIG. 11 illustrates a sixth modification example of a sliding member, and is a side view corresponding to FIG. 4.

FIG. 11 is a side view of a sliding member according to a sixth modification example, corresponding to FIG. 4. Arrow I denotes the direction in which the transfer belt moves circularly.

A sliding member 26G is disk-shaped, and has a hole 261G, which allows the rotation shaft 212 to be inserted therein.

Compared to a rectangular friction reducing member, the sliding member 26G has a shorter contact length at a portion of the side end surface 241 of the transfer belt 24 away from the driving roller 21.

The description on the first exemplary embodiment and the modification examples is thus complete. A second exemplary embodiment of the present disclosure will now be described.

Figure 12:
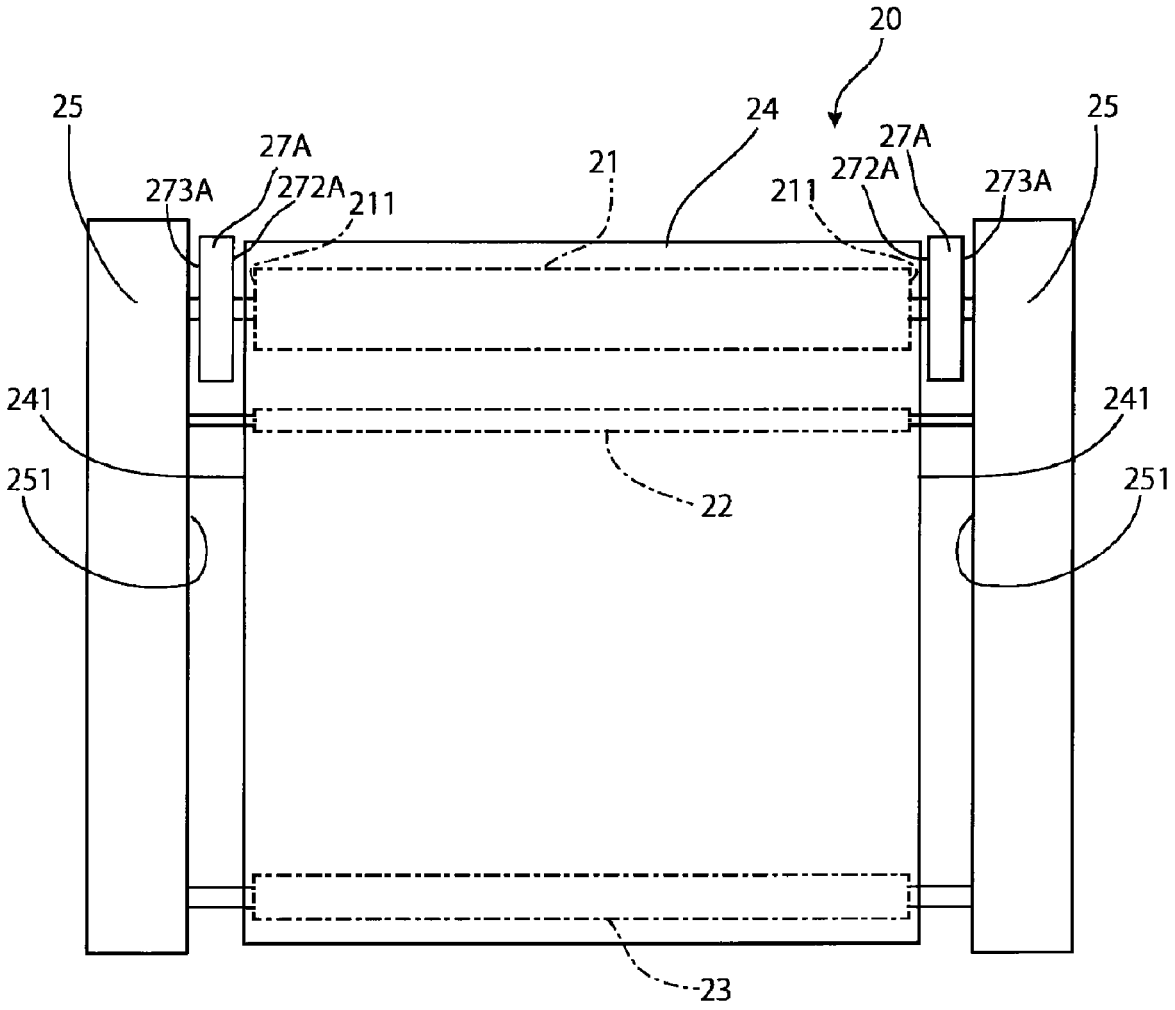
FIG. 12 is a schematic diagram of a transfer transporting device according to a second exemplary embodiment of the present disclosure.

FIG. 12 is a schematic diagram of a transfer transporting device according to a second exemplary embodiment of the present disclosure. Here, as in the case of the first exemplary embodiment illustrated in FIG. 3, the components described with reference to FIG. 2 are not described redundantly, and components added from FIG. 2 are mainly described.

Figure 13:
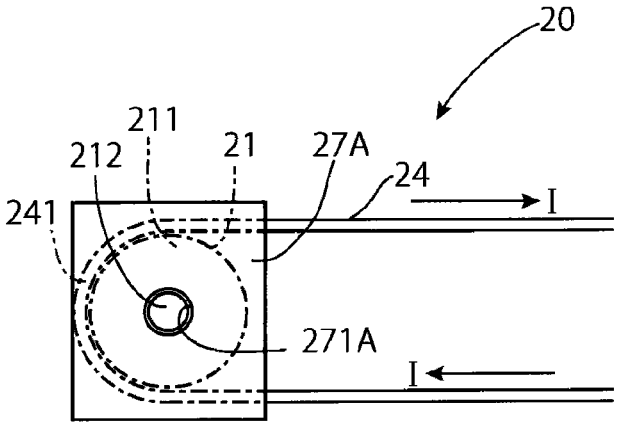
FIG. 13 is a side view of a portion of the transfer transporting device illustrated in FIG. 12, including a driving roller.

FIG. 13 is a side view of a driving roller of a transfer transporting device illustrated in FIG. 12. Arrow I denotes the direction in which the transfer belt moves circularly.

A transfer transporting device 20 illustrated in FIG. 12 includes a pair of rotating members 27A. In the side view of FIG. 13, one of the rotating members 27A is illustrated similarly to one of the sliding members 26A in the side view of FIG. 4.

The pair of rotating members 27A each have a hole 271A, which allows the rotation shaft 212 protruding from the corresponding one of the side end surfaces 211 of the driving roller 21 to extend therethrough. The pair of rotating members 27A are rotatably supported by the rotation shaft 212. As in the case of the sliding members 26A illustrated in FIG. 3, these rotating members 27A are members that, when the transfer belt 24 is deviated to one side, cause the side end surface 241 of the transfer belt 24 to come into contact with a side wall surface 272A, facing the side end surface 241 of the transfer belt 24. Here, the rotating members 27A are not fixed to the support members 25. When one side wall surface 272A is pressed by the corresponding side end surface 241 of the deviated transfer belt 24, another side wall surface 273A comes into contact with the outer wall surface 251 of the support member 25. Specifically, the rotating members 27A rotate while being interposed between the side end surfaces 241 of the transfer belt 24 and the outer wall surfaces 251 of the support member 25, and while sliding over the side end surfaces 241 of the transfer belt 24 and the outer wall surfaces 251 of the support members 25. The rotating members 27A, which slide while rotating, preferably have a lower coefficient of friction. As in the case of the sliding members 26A, the rotating members 27A are made of a material, such as POM or PTFE, having a coefficient of friction between themselves and the side end surfaces 211 of the driving roller 21 and a coefficient of friction between themselves and the outer wall surfaces 251 of the support members 25 lower than the coefficient of friction between the side end surface 241 of the transfer belt 24 and the outer wall surfaces 251 of the support member 25. In this case, reduction of the frictional force further reduces wearing of the transfer belt 24 than in the case where the rotating members 27A have a high coefficient of friction.

Compared to the structure where the side end surfaces 241 of the transfer belt 24 directly slide over the outer wall surfaces 251 of the support members 25, the structure including the rotating members 27A reduces the driving load exerted to drive the driving roller 21. As in the case of the sliding members 26A, the rotating members 27A also correspond to an example of an unloading member of an exemplary embodiment of the disclosure.

A rotating member according to a modification example will now be described.

Figure 14:
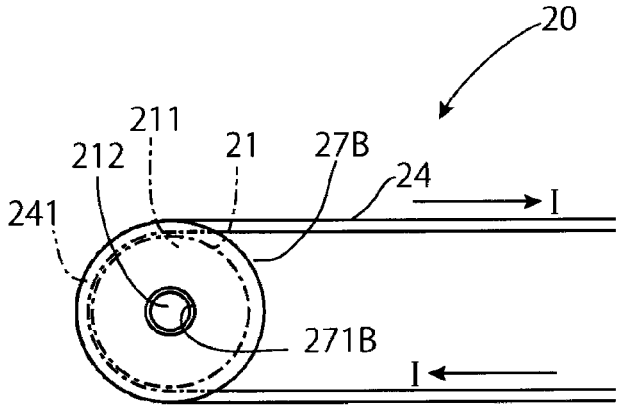
FIG. 14 is a side view of a modification example of a rotating member, corresponding to FIG. 13.

FIG. 14 is a side view of a rotating member according to a modification example, corresponding to FIG. 13. Arrow I denotes the direction in which the transfer belt moves circularly.

Rotating members 27B illustrated in FIG. 14 are disk-shaped. The rotating members 27B each have a hole 271B, which allows the rotation shaft 212 of the driving roller 21 protruding from the side end surfaces 211 to extend therethrough, and are rotatably supported by the rotation shaft 212.

Compared to the rectangular rotating members 27A illustrated in FIG. 13, each rotating member 27B illustrated in FIG. 14 keeps its length by which it is in contact with the side end surface 241 of the transfer belt 24 constant even while rotating, and accordingly, the transfer belt 24 is smoothly transported.

Employing the first exemplary embodiment, the second exemplary embodiment, and the modification examples effectively prevents occurrence of dust.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A transfer transporting device, comprising:

a plurality of rollers including:

a driving roller; and a driven roller, wherein the driving roller is disposed closer to an image carrier configured to carry a toner image, and wherein the driven roller is disposed apart from the driving roller downstream in a sheet transport direction;

an endless belt wound around the plurality of rollers;

a pair of support members each having an outer wall surface facing a corresponding one of side end surfaces of the belt, wherein the pair of support members is disposed on both sides of the belt to rotatably support a rotation shaft protruding from side end surfaces of the driving roller; and a pair of unloading members interposed between the outer wall surfaces of the pair of support members and the side end surfaces of the driving roller, wherein the pair of unloading members are configured to reduce, while being in contact with a corresponding one of the side end surfaces of the belt, a driving load on the driving roller more than in a case where the side end surfaces of the belt directly contact the outer wall surfaces, wherein the image carrier and the belt are configured to hold therebetween a sheet transported thereto to transfer the toner image on the image carrier to the sheet, wherein the image carrier and the belt are configured to transport the sheet downstream in the sheet transport direction, wherein each of the unloading members is configured to, when projected in a direction of the rotation shaft, extend to cover a portion of the corresponding side end surface of the belt upstream of the rotation shaft in the sheet transport direction, wherein each of the unloading members is configured to, when projected in the direction of the rotation shaft, cover the portion of the corresponding side end surface of the belt upstream of the rotation shaft in the sheet transport direction, and wherein each of the unloading members extends downstream in the sheet transport direction to at least a portion of a contact area between the belt and the image carrier.

2. The transfer transporting device according to claim 1, wherein the pair of unloading members are each fixed to the outer wall surface of a corresponding one of the support members.

3. The transfer transporting device according to claim 1, wherein each of the unloading members comprises a hole configured to allow rotation shaft protruding from the side end surfaces of the driving roller to extend therethrough, wherein each of the unloading members is rotatably supported by the rotation shaft, and wherein each of the unloading members is configured to allow the corresponding side end surface of the belt to contact a side wall surface of the unloading member facing the side end surface of the belt.

4. An image forming apparatus, comprising:

the transfer transporting device according to claim 1, wherein the image forming apparatus is configured to form an image on a sheet while transporting the sheet.

5. A transfer transporting device comprising:

a plurality of rollers comprising:

a driving roller; and a driven roller, wherein the driving roller is disposed closer to an image carrier configured to carry a toner image, wherein the driven roller being is apart from the driving roller downstream in a sheet transport direction;

an endless belt wound around the plurality of rollers;

a pair of support members each having an outer wall surface facing a corresponding one of side end surfaces of the belt, wherein the pair of support members is disposed on both sides of the belt to rotatably support a rotation shaft protruding from side end surfaces of the driving roller; and a pair of friction reducing members interposed between the outer wall surfaces of the pair of support members and the side end surfaces of the driving roller, wherein the pair of friction reducing members each has a coefficient of friction, between the friction reducing member and the corresponding side end surface of the belt, lower than a coefficient of friction between the side end surface of the belt and a corresponding one of the outer wall surfaces, wherein the image carrier and the belt are configured to hold therebetween a sheet transported thereto to transfer the toner image on the image carrier to the sheet, wherein the image carrier and the belt are configured to transport the sheet downstream in the sheet transport direction, wherein each of the friction reducing members is configured to, when projected in a direction of the rotation shaft, extend to cover a portion of the corresponding side end surface of the belt upstream of the rotation shaft in the sheet transport direction, wherein each of the friction reducing members is configured to, when projected in the direction of the rotation shaft, cover the portion of the corresponding side end surface of the belt upstream of the rotation shaft in the sheet transport direction, and wherein each of the friction reducing members extends downstream in the sheet transport direction to at least a portion of a contact area between the belt and the image carrier.

6. The transfer transporting device according to claim 5, wherein the pair of friction reducing members are each fixed to the outer wall surface of a corresponding one of the support members.

7. The transfer transporting device according to claim 5, wherein each of the friction reducing members is configured to, when projected in the direction of the rotation shaft, cover the portion of the corresponding side end surface of the belt upstream of the rotation shaft in the sheet transport direction, wherein each of the friction reducing members comprises a groove or a hole configured to prevent interference with the rotation shaft, and wherein each of the friction reducing members extends to at least a center of the rotation shaft in the sheet transport direction.

8. The transfer transporting device according to claim 5, wherein each of the friction reducing members is configured to, when projected in the direction of the rotation shaft, cover the portion of the corresponding side end surface of the belt upstream of the rotation shaft in the sheet transport direction, and wherein each of the friction reducing members extends to an edge of the corresponding side end surface of the driving roller downstream in the sheet transport direction.

9. The transfer transporting device according to claim 5, wherein each of the friction reducing members is configured to, when projected in the direction of the rotation shaft, cover the portion of the corresponding side end surface of the belt upstream of the rotation shaft in the sheet transport direction, and wherein each of the friction reducing members extends to an edge of the contact area downstream in the sheet transport direction.

10. The transfer transporting device according to claim 9, wherein each of the friction reducing members has a disk shape.

11. The transfer transporting device according to claim 5, wherein each of the friction reducing members is configured to, when projected in the direction of the rotation shaft, have an area upstream in the sheet transport direction, the area covering an edge of the side end surface of the belt most upstream in the sheet transport direction, and wherein each of the friction reducing members extends downstream in the sheet transport direction by a distance the same as a distance by which it extends upstream in the sheet transport direction from a center point of the rotation shaft.

12. A transfer transporting device comprising:

a plurality of rollers including:

a driving roller; and a driven roller, wherein the driving roller is disposed closer to an image carrier configured to carry a toner image, wherein the driven roller is disposed apart from the driving roller downstream in a sheet transport direction;

an endless belt wound around the plurality of rollers;

a pair of support members each having an outer wall surface facing a corresponding one of side end surfaces of the belt, wherein the pair of support members is disposed on both sides of the belt to rotatably support a rotation shaft protruding from side end surfaces of the driving roller; and a pair of rotating members each having a hole configured to allow a rotation shaft protruding from the side end surfaces of the driving roller to extend therethrough, wherein each of the pair of rotating members is rotatably supported by the rotation shaft, wherein each of the pair of rotating members is configured to allow the corresponding side end surface of the belt to contact a side wall surface of the rotating member facing the side end surface of the belt, wherein the image carrier and the belt are configured to hold therebetween a sheet transported thereto to transfer the toner image on the image carrier to the sheet, wherein the image carrier and the belt are configured to transport the sheet downstream in the sheet transport direction, wherein each of the rotating members is configured to, when projected in a direction of the rotation shaft, extend to cover a portion of the corresponding side end surface of the belt upstream of the rotation shaft in the sheet transport direction, wherein each of the rotating members is configured to, when projected in the direction of the rotation shaft, cover the portion of the corresponding side end surface of the belt upstream of the rotation shaft in the sheet transport direction, and wherein each of the rotating members extends downstream in the sheet transport direction to at least a portion of a contact area between the belt and the image carrier.

13. The transfer transporting device according to claim 12, wherein the pair of rotating members each have a disk shape with the hole at a center.

14. The transfer transporting device according to claim 12, wherein the rotating member has a coefficient of friction, between the rotating member and the corresponding side end surface of the driving roller, and a coefficient of friction between the rotating member and the corresponding outer wall surface, that are lower than a coefficient of friction between the side end surface of the belt and the outer wall surface.

* * * * *